United States Patent [19]

Evans

[11] 4,307,786

[45] Dec. 29, 1981

[54] BOREHOLE ANGLE CONTROL BY GAGE CORNER REMOVAL EFFECTS FROM HYDRAULIC FLUID JET

[76] Inventor: Robert F. Evans, 631 Honeywood La., La Habra, Calif. 90631

[21] Appl. No.: 101,851

[22] Filed: Dec. 10, 1979

Related U.S. Application Data

[62] Division of Ser. No. 928,703, Jul. 27, 1978, Pat. No. 4,211,292.

[51] Int. Cl.[3] ..... E21B 7/08

[52] U.S. Cl. ..... 175/231; 175/61; 175/67

[58] Field of Search ..... 175/61, 67, 231, 339

[56] References Cited

U.S. PATENT DOCUMENTS

| | | | |
|---|---|---|---|
| 2,075,064 | 3/1937 | Schumacher et al. | 175/231 |
| 2,153,680 | 4/1939 | Schumacher et al. | 175/231 |
| 2,317,010 | 4/1943 | Wingard | 175/398 |
| 2,859,941 | 11/1958 | Carroll et al. | 175/336 |
| 2,873,092 | 2/1959 | Dwyer | 175/231 |
| 3,092,188 | 6/1963 | Farris et al. | 175/61 |
| 3,142,347 | 7/1964 | Barnes | 175/349 |
| 3,825,081 | 7/1974 | McMahon | 175/73 |
| 3,903,974 | 9/1975 | Cullen | 175/17 |
| 4,015,673 | 4/1977 | Craig, Jr. et al. | 175/61 |

*Primary Examiner*—James A. Leppink
*Attorney, Agent, or Firm*—John R. Ley

[57] ABSTRACT

The advancement angle of a borehole cut by a rotary drill bit of the type which forms a cylindrical sidewall, a drill face and a circumferentially extending gage corner, is controlled by removing a different amount of the gage corner material over a selected partial arc of the gage corner circumference during each rotation of the drill bit. The different amount of material removed causes the remaining arc of the gage corner circumference to apply a slight lateral force on the drill bit, thus forcing the drill bit in a desired direction. Gage corner removal apparatus include a hydraulic fluid jet impinging upon the gage corner. Selectively activating the gage corner removal apparatus during each of a plurality of subsequent drill bit revolutions results in a cumulative angle change effect. Control apparatus is attached to the drill string at a position at which gravity induced sag causes the drill string to contact the low side portion of the borehole. The control apparatus is arranged for deriving energy from contact and rotation of the drill string relative to the low side portion. The energy derived activates the gage corner removal apparatus.

8 Claims, 11 Drawing Figures

21
41
24
48
60
46
45
47
49
51

21
7
47
46
49
50
7
42
46
57
24
54
55
48
60
53
56
24
20
41
47
58
59

FIG. 10
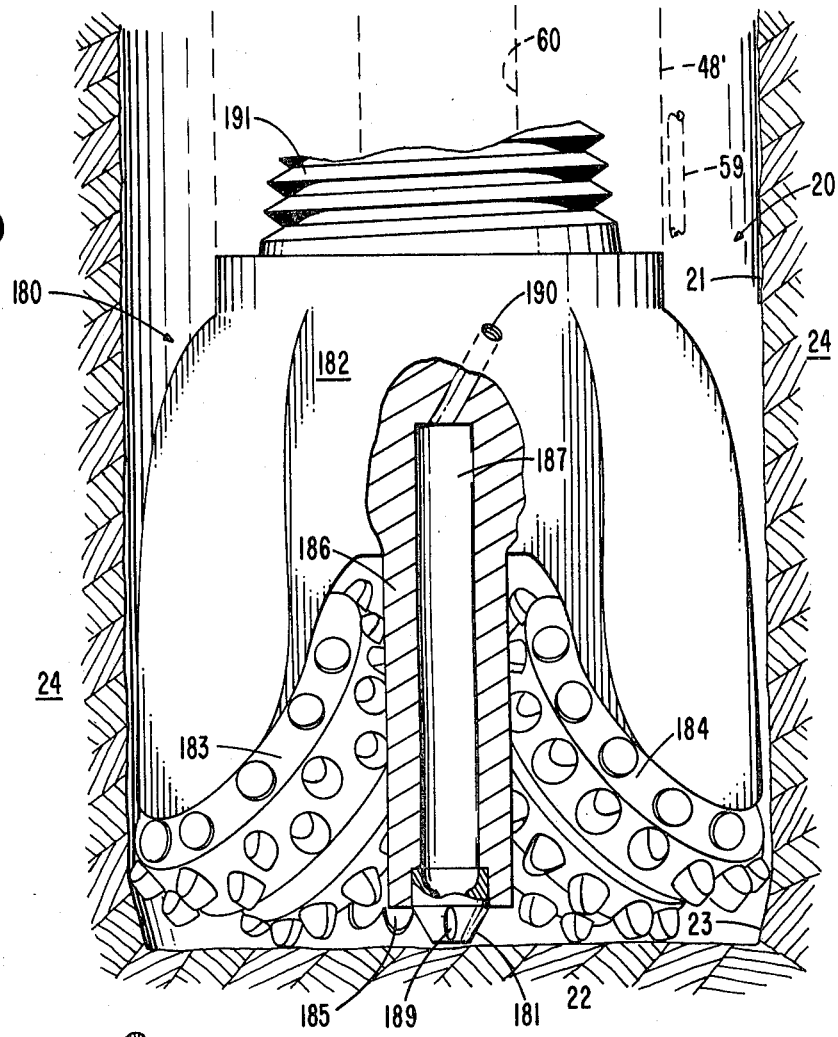
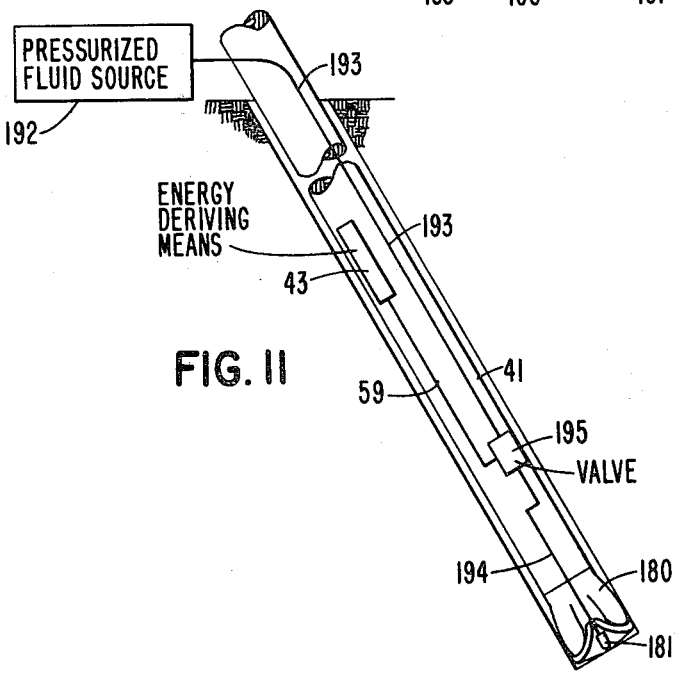
FIG. 11

BOREHOLE ANGLE CONTROL BY GAGE CORNER REMOVAL EFFECTS FROM HYDRAULIC FLUID JET

CROSS REFERENCE TO RELATED PATENT

This is a division of U.S. patent application Ser. No. 928,703, filed July 27, 1978, and issued as U.S. Pat. No. 4,211,292.

BACKGROUND OF THE INVENTION

1. Field of the Invention

This invention relates to and is useful for selectively controlling the angle of a well hole or a borehole as it is cut through earth material or the like. More particularly, the present invention relates to controlling the advancement angle of a borehole by selectively removing a different amount of material over a selected partial arc of a gage corner formed by a rotary drill bit.

2. Brief Introduction and Description of Prior Art

A variety of different methods and arrangements to control the advancement angle of a borehole are known and conventionally employed. Although the majority of these approaches are successful and reliable, certain disadvantages are inherent. Usually, changing or controlling the borehole deviation or advancement angle requires use of special drill bits, support collars, and special methods of drilling. In each case, the conventional drill bit and drill string must be pulled from the borehole and the special equipment inserted. After achieving the desired angle change, the special equipment is removed and use of the conventional equipment is resumed. Of course, each time an angle change is made, there is an obvious loss of drilling penetration rate while the special equipment is inserted, used and then removed. Control and guidance equipment is typically required for conventional angle change apparatus and methods and this equipment is generally very expensive and may require the presence of specially trained personnel to operate and control the equipment. Since a major factor in drilling well holes is time consumed, it is important to maintain a good drilling or penetration rate and to minimize the time when actual drilling does not proceed. Reducing the costs involved in making angle changes with conventional equipment is a further important factor in reducing the total cost of drilling boreholes.

Other disadvantages and limitations are known and appreciated by those knowledgeable in the art. Many of these prior art disadvantages and limitations can be overcome or significantly minimized by the present invention.

OBJECTS OF THE INVENTION

It is the major object of this invention to provide new and improved methods and apparatus for controlling the advancement angle of a well hole or borehole cut by a rotary drill bit. Another object is to teach a new and improved approach to controlling the advancement angle of a borehole by removing very small amounts of material from a partial arcuate portion of the circumference of a gage corner portion of the borehole during a plurality of revolutions of the drill bit, resulting in a gradual and acceptable angle change.

Another objective is to maintain acceptable and normal rates of drilling penetration while simultaneously controlling the advancement angle of the borehole. Still another object is to obtain positive and reliable control over the change in advancement angle and to accomplish such with relative inexpensive, self-effectuating and reliable methods and apparatus.

Further objects are to utilize certain reliable elements of conventional drill bits and drilling apparatus to control the borehole advancement angle, to selectively control the drilling effect of the drill bit during each revolution in a consistently predictable manner, to simplify the apparatus needed to control and change the advancement angle of the borehole, to minimize the need for special equipment and specially trained personnel to effect changes in the borehole angle, to obtain and apply angle controlling forces and energy without sophisticated sensors, control arrangements and the like, and to further teach a method of controlling the deviation angle of a borehole from vertical to be inherently self-correcting. Other advantages and achievements of the present invention will be apparent to those knowledgeable in the art.

SUMMARY OF THE INVENTION

The present invention involves rotary drill bits having cutting elements which cut a well hole or borehole defined by an axially extending cylindrical sidewall, a drill face extending essentially transversely with respect to the cylindrical sidewall and a gage corner extending circumferentially around the drill face and radially outward at an inclination from the drill face to the sidewall. To control the advancement angle, a different amount of material is removed over a selected partial arc of the circumference of the gage corner, as compared to that amount removed over the remaining partial arc of the circumference of the gage corner. The arcuate portion over which less material has been removed applies a slight lateral force to the drill bit in the radial direction in which it is desired to angle the borehole.

Means associated with the drill bit for removing the different amount of material from the gage corner are selectively activated to achieve the effect over a partial interval of each rotation of the drill bit. One arrangement for actuating the gage corner removal means involves control and energy deriving apparatus attached on the drill string at a predetermined position at which gravity induced sag causes the drill string to contact with the low side portion of the borehole. The energy deriving apparatus derives energy from rotation of the drill string relative to the stationary low side of the borehole sidewall. The energy is derived in pulses of duration related to the partial interval of drill string rotation during which the energy deriving apparatus contacts the sidewall. The energy pulses are applied to control the gage corner removal means. The preselected arc of the circumference of the gage corner over which the different amount of material is removed corresponds or is related to the interval of rotation during which energy is derived. The angular positional relationship between the gage corner removal means and the energy deriving means is selected to achieve a desired direction of angle advancement relative to the stationary low side portion of the sidewall.

The gage corner removal means includes means for emitting a hydraulic fluid jet impinging on the gage corner, such as a nozzle. The fluid jet removes an additional amount of material and increases the effectiveness of the drill bit cutting elements over the selected arc of the gage corner circumference. Pressurized fluid defining the jet is forced through the nozzle for a partial interval of one drill bit revolution and the fluid flow is terminated for the remaining interval of the drill bit revolution. Apparatus for controlling the fluid flow through the nozzle may include elements of the energy deriving apparatus.

The present invention is defined in the appended claims. A more complete understanding of the invention can be obtained from the following description of a preferred embodiment and from the drawings consisting of a number of figures.

BRIEF DESCRIPTION OF THE DRAWINGS

FIG. 8 illustrates a piston and cylinder activation means, and FIG. 9 illustrates an electrical solenoid activation means.

FIG. 10 is a side elevational view of a drill bit including means for selectively emitting a hydraulic fluid jet impinging on a gage corner of the borehole. A portion of the drill bit is broken away in section to illustrate the hydraulic fluid jet emitting means. The drill bit is shown connected to a drill collar illustrated in phantom and inserted within an axially sectioned borehole.

FIG. 11 is a schematic illustration of one embodiment of control and energy deriving apparatus utilized in conjunction with the bit shown in FIG. 10.

DETAILED DESCRIPTION OF PREFERRED EMBODIMENTS

By way of general introduction, control over the advancement angle of a borehole as it is cut or advanced through earth material or the like is achieved by effects created in a particular type of well hole or borehole. The characteristics of the borehole, as well as a discussion of one well known rotary drill bit having cutting elements arranged for cutting a borehole having these characteristics, is discussed in a first section below. To control the advancement angle, a different amount of earth material is removed over a partial selected arcuate portion of the circumference of a gage corner portion of the borehole, as compared to the amount of material removed over the remaining arcuate portion of the circumference of the gage corner. As a result of selective material removal, lateral forces induced by portions of the borehole force the drill bit to angle in a desired manner. A discussion of the general concepts and method of removing material from the gage corner and the advancement angle control effects created are discussed in the second section below. To achieve substantial angle control effects, it is necessary to remove the different amount of material over the selected arcuate portion of the circumference of the gage corner during each revolution of a number of sequential revolutions of the drill bit. The selected arc should be approximately consistent in angular duration and angular position relative to the borehole from one revolution to the next. A control and energy deriving arrangement for achieving these effects is discussed in the third section below. Lastly, one embodiment of means associated with the drill bit and the drilling apparatus for removing the gage corner material is discussed below.

Rotary Drill Bit and Borehole Characteristics

Figure 1:
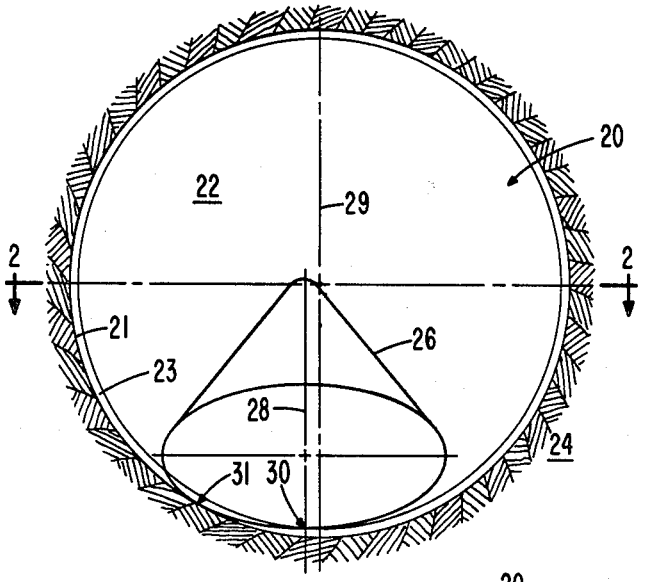
FIG. 1 is a top view looking axially into a borehole of the type to which the present invention relates and which is formed by a schematically illustrated cone cutter assembly.
Figure 2:
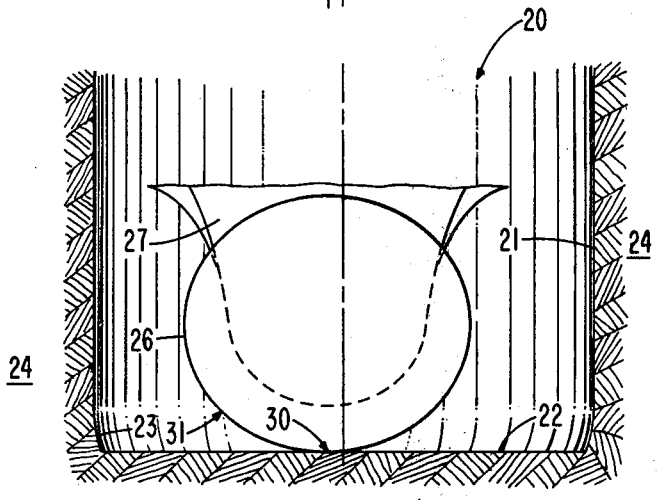
FIG. 2 is an axially extending section view taken substantially in the plane of line 2—2 of FIG. 1 and schematically illustrating the maximum circumference of the radial outermost cutting wheel element of the cone cutter assembly.

The characteristics of the borehole to which the present invention relates, and one type of rotary drill bit which effectively cuts a borehole having these characteristics, are known in the art. Referring to FIGS. 1 and 2, a borehole 20 is shown to include a cylindrical sidewall portion 21 which extends generally coaxially with the axis of the borehole, a drill face portion 22 extending essentially transversely with respect to the cylindrical sidewall portion 21, and a gage corner portion 23 which extends circumferentially around the corner periphery of the drill face 22 and radially outward at an inclination to the sidewall 21. Of course, the sidewall and drill face and gage corner portions are defined by the surrounding earth material 24 as the borehole 20 is cut. It is to rotary drill bits which cut a gage corner portion 23 of the borehole that this invention relates, in certain aspects.

One commonly used and very effective type of rotary drill bit which cuts a borehole having the sidewall 21 and drill face 22 and gage corner 23, is the well-known offset three-cone bit, one example of which is disclosed more fully in U.S. Pat. No. 2,148,372 to Garfield. An offset three-cone bit utilizes three groups of rolling cutting wheels and cutting elements, and each group or cutting assembly is formed in a general overall shape of a cone. Each of the cone-shaped cutting assemblies is offset, meaning that the rotational axis of each assembly extends at a slight intersecting angle or in spaced parallel relation with respect to a radial reference from the axial and rotational center of the drill bit. In both cases, the cone assembly axis does not pass through the bit axis. It is this offset geometry which causes the cone cutter assemblies to cut or leave the gage corner 23 as the borehole is cut. One offset cone cutter assembly 26 is schematically illustrated in FIGS. 1 and 2. A bit support structure 27 positions the cone cutter assembly 26 with its axis 28 of rotation offset in spaced parallel relation to a radial reference 29 extending from the axial and rotational center of the bit support structure 27. A description of the intersecting-angle geometry of an offset cone cutter assembly is present in the above identified Garfield patent. Both types of offset geometry are well known in the art.

The effect of the offset geometry is to create the gage corner portion 23, as can be generally understood from FIGS. 1 and 2. Due to the offset of each cone cutter assembly 26, the point 30, which is axially or vertically below the axis 28 of rotation of the cone cutter assembly 26, is spaced a slight radial distance inward with respect to the cylindrical sidewall 21. Another point 31 circumferentially displaced from the point 30 is the point at which the rotating cone cutter assembly 26 cuts the maximum diameter or gage of the borehole 20, and thus, also defines the cylindrical sidewall 21. As seen in FIG. 2, the point 31 is axially displaced from the drill face 22 and from the point 30. Because point 30 is located radially inward with respect to point 31 due to the geometry of the offset cone cutter assembly 26, a sloping or inclined gage corner 23 is formed between the point 31 at maximum diameter of the cylindrical sidewall and the point 30 at the maximum diameter of the drill face. The material between points 30 and 31 is typically curved, and it is this material which defines the gage corner 23. The cutting elements radially inwardly spaced from the point 30 on the cone cutter assembly 26 remove particles of material 24 to define the drill face 22.

The advantages of an offset three-cone rotary drill bit are well known. The offset geometry of the cone cutter assemblies achieves a combination of rolling and scraping action on the earth material defining the drill face and gage corner. The rolling and scraping action removes particles of material much more effectively and more quickly than if the offset geometry was not utilized. Due to the proven advantages of the offset three-cone bit, it is expected that such a bit will be utilized in either a substantially original or slightly modified form in practicing the present invention. It should be understood, however, that other types of rotary drill bits which cut a circumferential gage corner extending at an inclination outward from the drill face to the sidewall are within the scope of the present invention.

The substantial advantage to utilizing the offset three-cone bit or a similar bit in practicing the invention is that no reduced effectiveness or loss of penetration rate occurs as the borehole is cut and simultaneously angled in the desired manner. Many prior art approaches of controlling the advancement angle of the borehole require removal of the conventional drill bit and insertion into the borehole of special cutting devices and the like. Other prior art approaches involve stopping the rotation of the drill bit and attached drill string while an auxiliary cutting effect takes place. In most prior art approaches, alterations in structure of the bit or in the way in which the bit is operated in terms of revolutions per minute, weight on the bit or hydraulic cuttings removal are required, and these alterations adversely affect performance and the drilling penetration rate. Maintaining a good drilling rate is particularly important because of the economics involved in drilling and in angling or correcting the direction of a borehole. The extra drill rig time consumed, the cost of extra or special tools, and the cost of extra and specialized skilled personnel can amount to a considerable expense with the currently used approaches to angle control.

Angle Control

Figure 3:
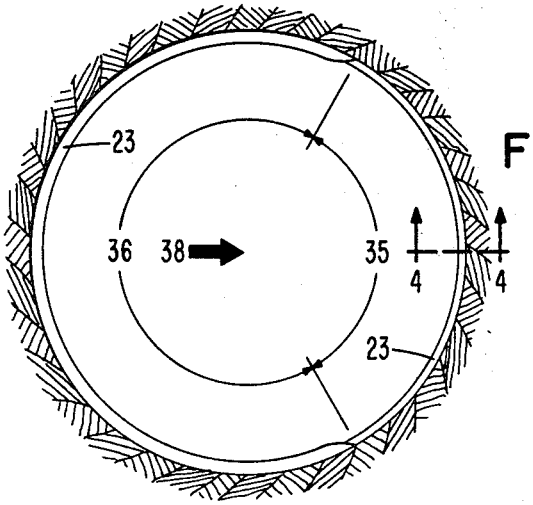
FIG. 3 is a top view similar to FIG. 1 illustrating a selected partial arcuate portion of the circumference of the gage corner and a remaining arcuate portion of the circumferential gage corner.
Figure 4:
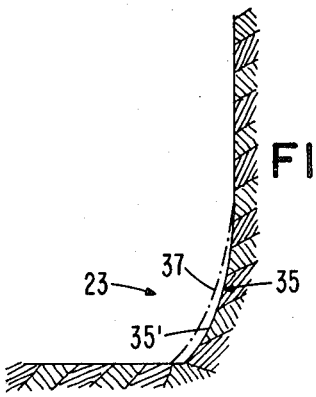
FIG. 4 is an enlarged fragmentary section view illustrating removal of a different amount of the gage corner of the borehole, taken in an axially extending section plane of line 4—4 of FIG. 3.

To control the angle of advancement of the borehole cut by the rotary drill bit, a different amount of material is removed over a partial preselected arc of the circumference of the gage corner than the amount of material removed over the remaining partial arc of the circumference of the gage corner. FIGS. 3 and 4 schematically illustrate this angular control concept. The partial preselected arc is referenced 35 in FIG. 3, and the remaining arc of the circumference of the gage corner 23 is referenced 36. FIG. 4 illustrates in exaggerated condition an additional amount of material removed from the preselected arc 35. The dotted lines 37 indicate, for comparison purposes, a normal amount of material which would normally define the gage corner resulting from normal operation of the drill bit. By removing additional material to a level indicated by the solid line 35', the size and radial inclination of the gage corner 23 is slightly reduced over the arc 35. However, the size and inclination of the gage corner material in the remaining arc 36 is that normally cut by the rotary drill bit, represented at 37. Consequently, the remaining arc 36 of the gage corner extends radially inward at the full or normal inclination.

The remaining partial arc 36, being of full normal size and inward inclination, applies a slight radially inward directed or lateral force on the drill bit in the general radial direction of the selected arc 35. The slight lateral force is illustrated by a vector referenced 38. In time after a sufficient number of drill bit revolutions, the lateral force applied with each revolution effectively forces the drill bit in the direction of the vector 38. The drill bit begins to advance laterally in the direction of vector 38, and the advancement angle of the borehole is changed.

The manner in which one arcuate portion of the inclined gage corner 23 applies lateral force on the drill bit to control the advancement angle is somewhat similar in overall effect to a whipstock effect known in the art to occur when a conventional drill bit encounters a sloping geological formation of different hardness. The whipstock effect simply describes a naturally-occurring physical result, in contrast to the present invention, which selectively and positively creates angle control effects on the drill bit. One description of the whipstock effect and a further description of the offset three-cone drill are found in an article appearing in *Drilling*, May, 1965, Page 34.

The amount of material removed with each revolution over the preselected arc need not be large to control the advancement angle. In fact, very small amounts will achieve acceptable angular control. Removal of a very small amount over the preselected arc during each of a plurality of subsequent revolutions creates anistropic action sufficient to achieve significant angular deviation. As an example, it is possible to change the angle of the borehole advancement by approximately 1° by forcing the drill bit laterally by an amount of two to three thousandths of an inch during the course of drilling 100 feet. It is apparent, therefore, that by operating the drill bit and creating different gage corner removal effects over a sufficient time period, sizeable angle deviation build-up will occur and effective control over the advancement angle of the borehole results. Such lateral drilling rates are not difficult to obtain and can be achieved without sacrificing the normal adequate performance of the rotary drill bit.

It should also be noted that in addition to removing an additional amount of material over that which would normally be removed, as is the situation illustrated in FIG. 4, a related concept involves inhibiting the removal of a normal amount of gage corner material over the remaining partial arc while allowing normal removal of the material over the remaining partial arc. Of course, the overall effect of either removing additional material or inhibiting normal removal of material is the same: a lateral force is applied to the drill bit by the arcuate portion of the gage corner circumference over which the greater amount of material remains, and the drill bit is angled appropriately. Means for inhibiting the removal of a normal amount of gage corner material over one partial arc while allowing normal removal over the remaining partial arc is disclosed and claimed in the aforementioned U.S. Pat. No. 4,211,292, of which this is a division.

To achieve suitable angle control, the different amount of material must be removed over the preselected arc during each of a number of sequential revolutions. Furthermore, the angular positions of the beginning and ending points of the preselected arc must be approximately the same during each revolution of the drill bit so that the lateral force 38 is applied approximately in the same lateral direction to the drill bit during each revolution. One advantageous arrangement for achieving this effect is next described.

Control and Energy Deriving Arrangement

To remove the different amount of material over the preselected arc, gage corner removal means are associated with the rotary drill bit. The gage corner removal means are activated during a selected partial interval of one or each rotation of the drill bit, to remove the different amount of material from the gage corner over the selected arc. It is therefore important to activate and deactivate the gage corner removal means at approximately the same rotational positions during each drill bit rotation. The interval of rotation during which the gage corner removal means is activated corresponds in angular duration to the selected arc of the circumference of the gage corner over which the different amount of material is removed.

One control arrangement for activating the gage corner removal means is to provide a control means at the surface of the earth which is operatively connected for activating the gage corner removal means over the preselected arc. Such control means employs sensors or the like for determining the rotational position of the drill bit as it is continually rotated, and selectively supplies energy to the gage corner removal means during the selected and predetermined interval of drill bit rotation.

A more appropriate control means for activating the gage corner removal apparatus by deriving energy from rotation of the drill string relative to the borehole sidewall is illustrated in FIGS. 5 to 9. The borehole 20 shown in FIG. 5 extends axially downward at an angle with respect to a vertical reference. A rotary drill bit 40 is attached to the end of a drill string 41 and inserted into the borehole. The drill string 41 comprises a plurality of conventional drill collars 48 connected together in a manner known in the art. The drill bit 40 is attached to the end of the drill string and placed in contact with the drill face 22 of the borehole. The drill string 41 extends through the borehole 20 to the surface of the earth where conventional drilling apparatus 44 is connected to the drill string for rotating the drill string and the drill bit connected at the end of the drill string. Of course, rotating the drill bit at the drill face cuts and removes particles of the material 24 to advance the borehole.

Because the drill string 41 extends at an angle with respect to a vertical reference, gravity bends or induces the drill string toward the low side portion of the cylindrical sidewall of the borehole. The gravity induced sag in the drill string causes it to contact the low side portion of the sidewall at a point 42 axially spaced from the drill face and drill bit. Means, generally referenced 43, are fixed to the drill string at point 42 for the purpose of deriving energy from rotational movement of the drill string relative to the stationary cylindrical sidewall over a selected partial interval of each rotation of the drill string during which the means 43 contacts the low side portion of the sidewall. Of course, the distance between the drill bit and the point 42 will vary depending upon a number of factors including the angle of the borehole 40 with respect to a vertical reference and the stiffness of the drill collars comprising the drill string.

Figures 6, 7:
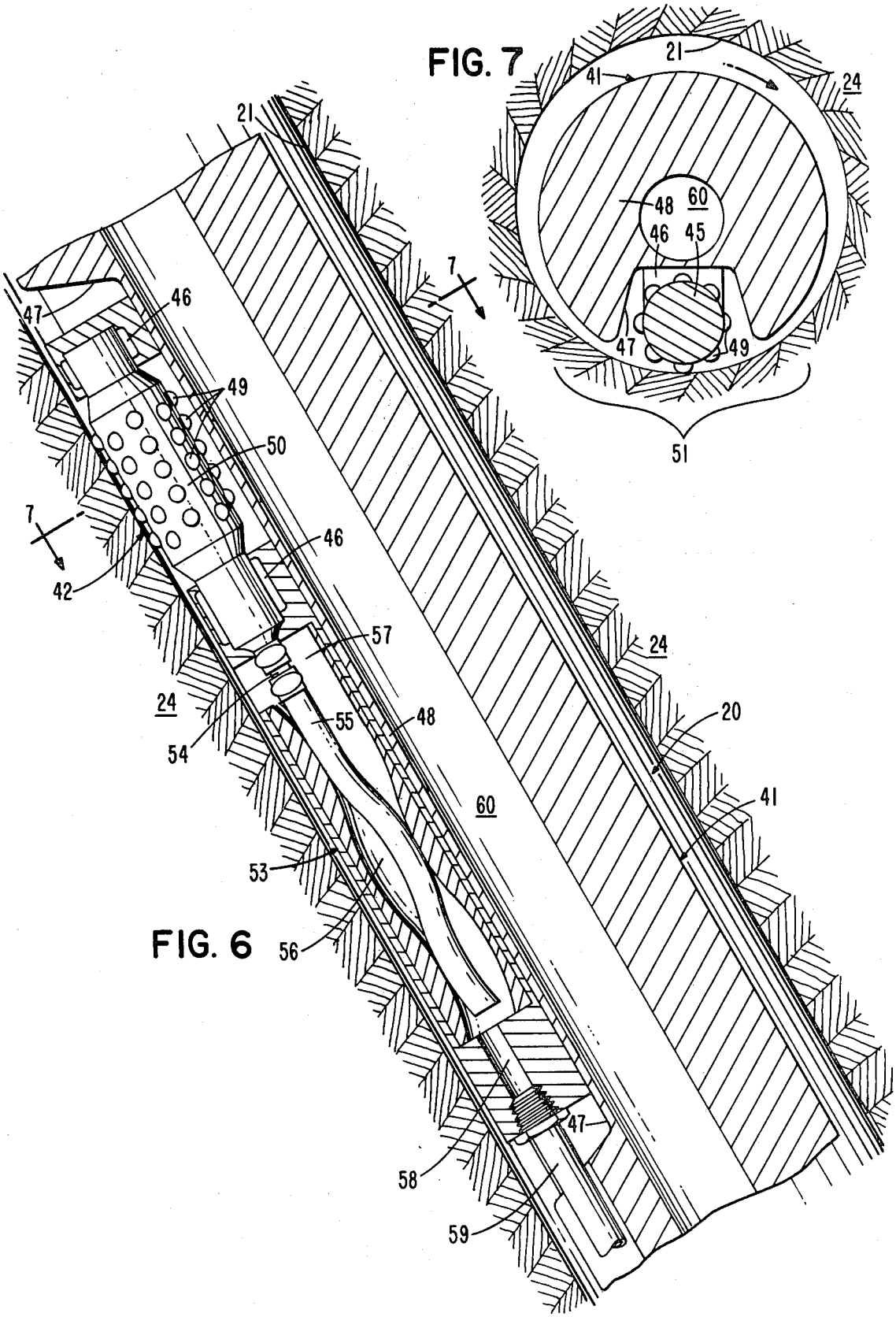
FIG. 6 is an axially extending section view taken substantially in the plane of line 6—6 of FIG. 5, in which the drill string and control and energy deriving apparatus have been rotated 180°.
FIG. 7 is a transverse section view taken substantially in the plane of line 7—7 of FIG. 6.

One example of means 43 for deriving energy is illustrated in FIGS. 6 and 7. A roller member 45 or other driver means is fixed in an exposed condition to the exterior surface of the drill string 41. Conventional bearing connection means 46 attach the roller member 45 to the drill string, and the bearings 46 allow the roller member to rotate relative to the drill string. The roller member 45 and bearings 46 are received within a milled pocket 47 formed in the exterior surface of a drill collar 48 comprising a portion of the drill string 41. Teeth 49 or other frictional engagement members extend from an outer cylindrical surface 50 of the roller member 45. The teeth 49 of the roller member are exposed at the outer periphery of the drill string and are thus free to contact and roll against the low side portion of the sidewall 21 at the point 42. The teeth 49 are made of conventional wear-resistant material. A conventional drilling fluid passage 60 extends axially through the drill collar 48 and the drill string 41.

As the drill string 41 rotates, the roller member 45 is periodically rotated into contact with the low side portion 51 of the cylindrical sidewall 21, as is shown in FIG. 7. During contact with the low portion 51, the teeth 49 contact the sidewall 21, and the rotation of the drill string relative to the stationary sidewall causes the roller member 45 to rotate about its bearing connection means 46. With further drill string rotation, the roller member 45 moves to a position at which the teeth 49 no longer contact the cylindrical sidewall. Thus, roller member 45 contacts and rolls against the low side portion 51 of the cylindrical sidewall during a predetermined partial interval of drill string rotation, and, during the remaining partial interval of the drill string rotation, the roller member 45 avoids contact with the sidewall 21. This periodic contact results because the axial center of the drill string does not coincide with the axial center of the borehole 20 due to the sag induced by gravity.

Thus, the roller member is rotated during a selected partial interval of the drill string rotation and is not rotated during the remaining partial interval of drill string rotation. Rotation occurs at the same rotational position of the drill string during each revolution, since the roller member is at a fixed position and the low side portion 51 presents a stationary surface upon which the roller member periodically contacts and rolls against.

Rotational movement of the roller member 45 is applied to an energy generator means to generate energy. As shown in FIG. 6, a hydraulic pump 53 such as a conventional progressive cavity pump is operatively connected by connection means 54 to be rotated by the roller member. The connection means 54 transmits rotation from the roller member 45 to the pump 53 and rotates a screw-like rotor member 55 within a helical shaped stator 56. An intake opening 57 at one end of the stator 56 receives fluid screened free of coarse particle cuttings and utilized by the pump 53. The fluid is forced through a series of progressive cavities formed by interaction of the rotating rotor member 55 and stationary stator 56, and the fluid is pressurized and delivered from an outlet opening 58 of the pump 53. A conduit 59 connected at the outlet 58 of the pump conducts the pressurized fluid for use by the gage corner removal means associated with the drill bit. The conduit 59 extends along the exterior of the drill string 41 preferably within a milled channel, not shown, or extends within the interior of the drill string. The supply of hydraulic fluid for the pump 53 is obtained from the outflow of fluid and particle cuttings flowing out of the borehole between the drill string and the cylindrical sidewall or from drilling fluid in the passage 60, by screening it free of coarse particle cuttings or from other sources as will be described. The outflow of fluid and particle cuttings between the drill string and the sidewall is established by directing a flow of drilling fluid through the passage 60 in the drill string and directing the drilling fluid from wash jets of the drill bit onto the drill face. The particles cut and removed by the drill bit are thus washed away from the drill face and out of the borehole, as is conventional in the art.

It is apparent from the foregoing description of the energy deriving means 43 that the pump 53 supplies energy only when rotated by the roller member 45. The roller member 45 is rotated only during the partial interval of each rotation of the drill string when the roller member contacts and rolls against the low side portion of the cylindrical sidewall. Therefore, the energy is supplied in the form of pulses delivered during the time interval that the roller member contacts and rolls against the cylindrical sidewall.

Figures 5, 8, 9:
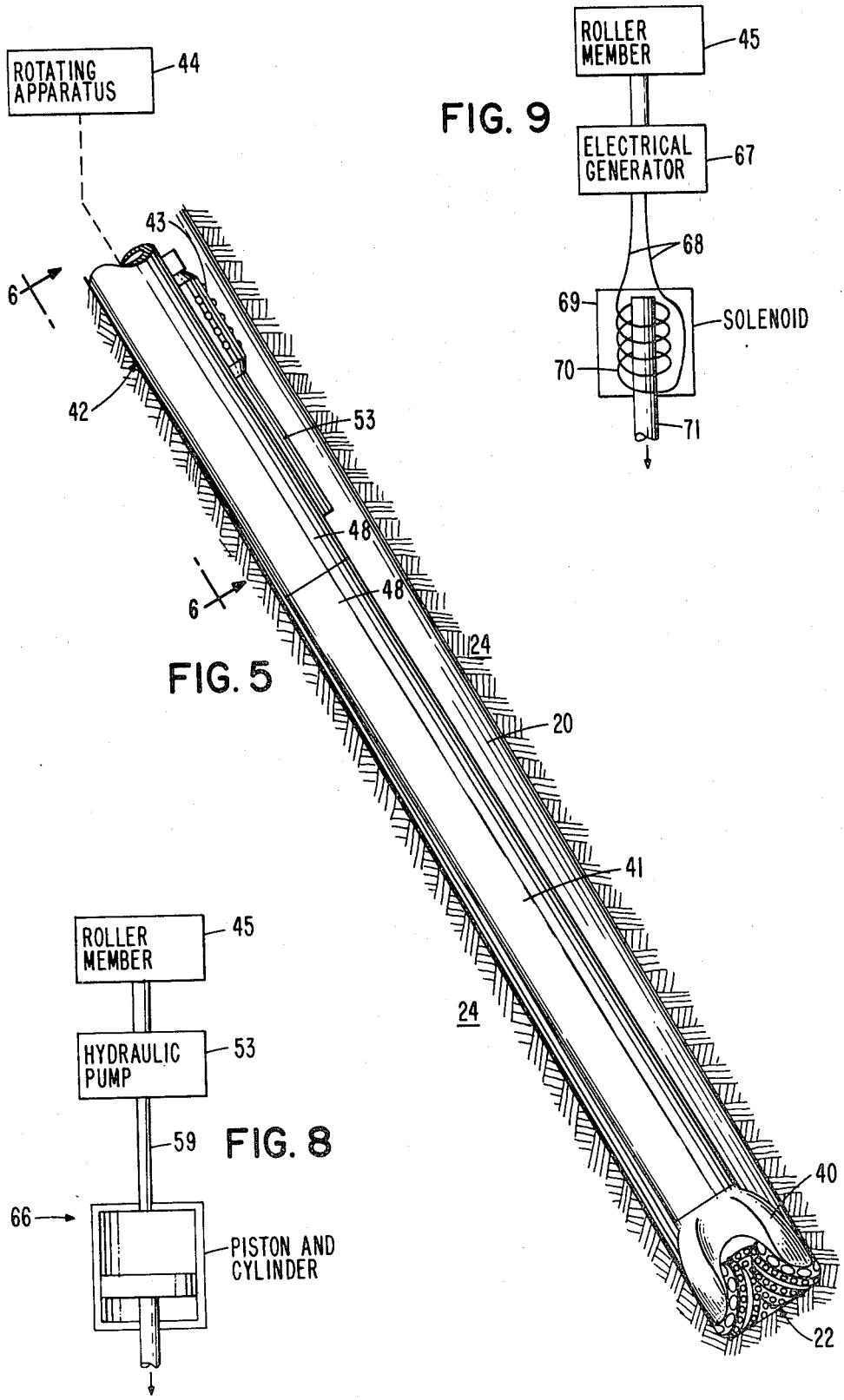
FIG. 5 is an axially sectioned view of a borehole extending at an angle from a vertical reference into which a drill string and drill bit have been inserted, and a schematic view of a control and energy deriving means of the present invention.
FIGS. 8 and 9 are schematic illustrations of actuating means associated with the control and energy deriving apparatus of the present invention. Specifically.

The energy pulses are utilized for operatively controlling the removal of the different amount of material over the selected partial arc of the circumference of the gage corner. The energy pulses activate the gage corner removal means associated with the drill bit. One example of activation means utilizing the hydraulic pressure pulses is a piston of cylinder arrangement 66 schematically illustrated in FIG. 8. The pulses of pressurized hydraulic fluid are supplied to the piston and cylinder arrangement 66 and force the piston to move. Another example of activation means is illustrated in FIG. 9. The roller member 45 is operatively connected to operate an electrical generator 67. Electrical energy derived from the operating generator 67 is supplied over conductors 68 to a solenoid arrangement 69. The solenoid includes a conventional coil 70 for producing electromagnetic flux which acts on and moves a magnetic armature 71. Both the piston shown in FIG. 8 arrangement and the armature shown in the FIG. 9 arrangement include biasing means to return these moveable elements to the original position after the pulse of energy terminates.

In the described manner, energy is derived from rotation of the drill string relative to the cylindrical sidewall by energy deriving means 43. The energy derived is applied to activation means, such as the piston and cylinder arrangement 66 or the solenoid arrangement 69. In other cases the energy derived may be directly applied to the gage corner, in which circumstance the energy deriving means also functions as activation means.

The activation means is operatively associated with the gage corner removal means. Upon activation, the gage corner removal means selectively removes the different amount of material over the preselected partial arc of the circumference of the gage corner. The gage corner removal means is preferably activated only so long as the pulse of energy is applied. The pulse of energy is applied during the interval of drill string rotation time that the roller member 45 contacts the low side portion 51 of the sidewall. The interval of drill string rotation corresponds or bears a predetermined relationship to the angular duration of the preselected arc. By adjusting the predetermined angular positions of the gage corner removal means and the energy deriving means a physical relationship is established between the stationary low side portion 51 of the borehole and the direction in which it is desired to angle the borehole. As explained, the direction in which the borehole will be angled is determined by the angular position over which a different amount of material is removed from the preselected arc. The predetermined arc can be located in any angular position relative to the low side of the borehole sidewall to advance the borehole at a desired angle. By selecting the proper angular relationship of the roller member 45 and the gage corner removal means, an arrangement for automatically correcting any significant deviation of the borehole from vertical is obtained.

Although one roller member 45 has been illustrated connected to the drill string, it may prove advantageous to employ three equally circumferentially spaced rollers about the outer exterior surface of the drill string. Three equally spaced rollers would reduce lateral force impulses supplied to the drill string as each roller rotates into contact with the low side portion of the sidewall. The three equally spaced rollers have a smoothing effect since one of the rollers would probably be in contact with the low side portion at all times. All three rollers could be connected to separate hydraulic pumps or electrical generators. The output energy of each electrical generator or pump could be appropriately controlled or delivered for use in controlling a drilling operation of the nature described. Energy deriving means can be employed at a number of different axial distances from the drill bit. An appropriate control arrangement controls the gage corner removal means by energy derived from selected ones of the energy deriving means.

Fluid Jet

A rotary drill bit 180 shown in FIG. 11 includes gage corner removal means in the form of a fluid jet emitting means for emitting pressurized fluid impinging essentially only on the gage corner 23 of the borehole. The fluid jet emitting means is in the form of a fluid jet emitting nozzle 181 positioned on a drill bit structure 182 to emit the jet therefrom on the gage corner. Three conventional offset cone cutter assemblies 183, 184 and 185 are also connected to the bit support structure 182. The cutting elements of the cone cutter assemblies 183–185 are arranged to cut the borehole 20 defined by the cylindrical sidewall 21, the drill face 22 and the circumferential gage corner 23.

The fluid jet emitting nozzle 181 is received at the lower end of a hollow extension 186 of the bit support structure. The extension 186 extends from the bit support structure intermediate the cone cutter assemblies 183 and 184 at a position normally occupied by one of the three conventional wash jets associated with the conventional offset three-cone drill bit. The extension 186 is terminated at an end point adapted to be adjacent the gage corner 23. A fluid conducting channel 187 is formed in the extension 186 to conduct fluid to the nozzle 181. The nozzle 181 includes an orifice 189 oriented to emit a stream or jet of fluid onto the gage corner in a downward and radial outward direction. An inlet opening 190 communicates with the channel 187. A conventional connector, not shown, connects the conduit 59 from the hydraulic pump 53 to the inlet opening 190. A threaded end connection 191 of the drill bit structure connects the drill bit 180 to the endmost drill collar 48 of the drill string.

Means for selectively conducting pressurized fluid through the fluid jet emitting nozzle 181 takes one form as the hydraulic pump 53 and operatively connected roller member 45. Hydraulic fluid, preferably taken from the fluid flowing in the center passage 60 of the drill string or from the drilling fluid screened free of coarse particle cuttings, is pressurized by the pump 53 and delivered through the conduit 59 to the fluid jet emitting nozzle 181. Receipt of the pressurized fluid activates the jet emitting means by creating the jet impinging on the gage corner. Although not shown in FIG. 6, an opening is formed through the drill collar 48 so that the inlet opening 57 of the pump 53 receives hydraulic fluid only from the drilling fluid passage 60. Referring back to FIG. 10, the pressurized fluid is emitted from the orifice 189 onto the gage corner during the selected interval of drill bit and drill string rotation during which the hydraulic pump 53 is operable. The angular position of the roller member 45 relative to the fluid jet emitting nozzle 181 is determined so that the selected arc upon which the pressurized fluid is emitted is correlated to the angle in which it is desired to advance the drill bit and to the low side portion of the cylindrical sidewall. Thus, the roller member and hydraulic pump arrangement form one example of means for selectively conducting pressurized fluid through the nozzle 181 for a predetermined partial interval of one drill bit rotation and for terminating conduction of the pressurized fluid for the remaining interval of the drill bit rotation. The orifice 189 of nozzle 181 is sufficiently restrictive to prevent the rotor 55 of the pump 53 from being driven as a hydraulic motor by the pressurized fluid.

Two types of effects can be achieved by emitting the pressurized fluid on the gage corner 23. If the emitted fluid is of sufficient pressure to exceed the strength of the earth material 24, the emitted fluid jet will actually cut and remove an amount of material over the gage corner in addition to that removed by the cutting elements of the cone cutter assemblies 183–185. The other effect is that the emitted fluid jet will remove and wash away the particle cuttings more efficiently over the selected arc than the particle cuttings are removed from other areas of the drill face and gage corner by the conventional wash jets of the drill bit 180. By more effectively removing these particles, the cutting elements of the immediately following cone cutter assembly have an increased effect or efficiency in removing slightly additional amounts of gage corner material over the selected arc. In either case, the fluid jet emitted onto the gage corner has the effect of causing a different amount of material to be removed over the selected arc than that normally removed by the cutting elements of the cone cutter assemblies.

Another embodiment of the fluid jet emitting control arrangement is schematically illustrated in FIG. 11. A source of pressurized fluid 192 is positioned on the surface of the earth or at some other location for use with the drilling apparatus. Conduits 193 and 194 conduct the source of pressurized fluid to the fluid jet emitting means or nozzle 181 of the drill bit 180. A selectively controllable valve 195 is positioned between conduits 193 and 194 to open and close the conduit 194 to the source 192 of pressurized fluid. The valve 195 is operated by the energy deriving means 43 positioned at the predetermined position on the drill string 41. As the roller member 45, or some other element of the energy deriving means 43, comes in contact with the low side portion of the sidewall, the valve 195 is activated to one condition, either opened or closed. When the roller member 45 moves out of contact with the sidewall, the valve 195 is activated to the other condition. The valve thus controls the delivery of pressurized fluid over the selected arc. The valve 195 may be electrically or mechanically activated. An example of mechanically activated valve is a conventional valving arrangement which is mechanically moved between an open and a closed condition by activating means such as a piston and cylinder assembly 66.

It is apparent that the fluid jet emitting nozzle 181 causes an effect on the selected arc of the circumference of the gage corner, resulting in removal of a different amount of material over the selected arc than that amount of material removed over the remaining partial arc of the gage corner circumference. Thus, the arrangements described and illustrated in FIGS. 10 and 11 effectively control the advancement angle of the borehole by gage corner removal effects.

From the foregoing description, it is apparent that effective angle changes can be achieved by very small removals of different amounts of material over a selected partial arc of the gage corner circumference, as compared to the material removed from the remaining partial arc of the circumference. Furthermore, the gage corner removal means for removing the different amount of material cooperate with known rotary drill bits to achieve a normal and acceptable rate of drilling penetration as the advancement angle of the borehole is changed or controlled. The control and energy deriving apparatus operates reliably and consistently as an inherent result of drill string rotation. Furthermore, the control and energy deriving apparatus operates in predetermined correlated relationship with a stationary reference, the low side portion of the sidewall, and controls the drill bit relative to the stationary reference to achieve consistent gage corner removal effects from one revolution of the drill bit to the next. It is apparent, therefore, that the present invention significantly advances the development of the art relative to controlling the advancement angles of boreholes cut by rotary drill bits.

Preferred embodiments of the present invention have thus been described with a degree of particularity. It should be understood, however, that the specificity of the present disclosure has been made by way of example, and that changes in details of features may be made without departing from the spirit of the invention.

What I claim is:

1. In apparatus for drilling a borehole in earth material including a rotary drill bit, a drill string connected to the drill bit and extending into the borehole to position the drill bit in drilling contact with the earth material in the borehole, means for selectively continuously rotating the drill string and the drill bit connected thereto to drill and cut the borehole into the earth material, and an improved means for selectively controlling the advancement angle of the borehole cut by rotating said drill bit against the earth material comprising, in combination:

a drill bit support structure;

a cutter assembly positioned on said bit support structure, said cutter assembly comprising cutting elements arranged for cutting an axially extending cylindrical sidewall of the borehole and a drill face of the borehole extending transversely with respect to the sidewall and a gage corner of the borehole extending circumferentially from the drill face radially outward at an inclination to the sidewall;

fluid jet emitting means connected to said drill bit structure for emitting at least one jet of pressurized fluid impinging essentially only on the gage corner material formed by said cutter assembly;

means adapted for selectively conducting pressurized fluid through said jet emitting means during a predetermined partial interval of each one of a plurality of revolutions of said drill bit and for terminating conduction of pressurized fluid through said jet emitting means during the remaining interval of the one revolution of said drill bit, while said cutter assembly is operatively cutting the earth material during rotation of the drill bit; and the pressurized fluid emitted through said jet emitting means being sufficient to cut and remove additional material from the gage corner over a predetermined partial arc of the gage corner circumference corresponding to the predetermined partial interval of each revolution, the predetermined partial arc and the remaining partial arc of the gage corner circumference applying a lateral force to the cutter assembly during continued rotation of the drill bit to selectively control the advancement angle.

2. A rotary drill bit as defined in claim 1 wherein said jet emitting means emits pressurized fluid to impinge essentially on one point on the circumference of the gage corner material.

3. A rotary drill bit as defined in claim 1 wherein said means adapted for selectively conducting pressurized fluid through said jet emitting means comprises:

a source of pressurized fluid, a conduit operatively connecting said pressurized fluid source with said jet means, and means operatively connected in said conduit for conducting pressurized fluid to said jet emitting means during the predetermined interval of rotation and for terminating the flow of pressurized fluid to said jet emitting means during the remaining interval of rotation.

4. An invention as defined in claim 3:

further comprising a drill string connected to said drill bit and having a hollow center interior opening adapted for conducting a supply of pressurized drilling fluid therethrough, and wherein said conduit operatively connects the hollow interior opening of said drill string to said fluid emitting jet means.

5. An invention as defined in claim 3 wherein:

said conducting and terminating means comprises control means fixed to said drill string at a predetermined position axially spaced from said connected drill bit at which gravity induced sag in said drill string causes said control means to contact the low side portion of said sidewall during an interval of rotation of said drill string and to avoid contact with the sidewall during the remaining interval of rotation, said control means operatively conducting pressurized fluid to said fluid jet emitting means during the interval of contact with the low side portion of said borehole.

6. In apparatus for drilling a borehole in earth material including a rotary drill bit, a drill string connected to the drill bit and extending into the borehole to position the drill bit in drilling contact with the earth material in the borehole, means for selectively continuously rotating the drill string and the drill bit connected thereto to drill and cut the borehole into the earth material, and an improved means for selectively controlling the advancement angle of the borehole cut by rotating said drill bit against the earth material comprising, in combination:

a drill bit support structure;

a cutter assembly positioned on said bit support structure, said cutter assembly comprising cutting elements arranged for cutting an axially extending cylindrical sidewall of the borehole and a drill face of the borehole extending transversely with respect to the sidewall and a gage corner of the borehole extending circumferentially from the drill face radially outward at an inclination to the sidewall;

fluid jet emitting means connected to said drill bit structure for emitting at least one jet of pressurized fluid impinging essentially only on the gage corner material formed by said cutter assembly;

means adapted for selectively conducting pressurized fluid through said jet emitting means during a predetermined partial interval of each one of a plurality of revolutions of said drill bit and for terminating conduction of pressurized fluid through said jet emitting means during the remaining interval of the one revolution of said drill bit, said means for selectively conducting pressurized fluid to said fluid emitting jet means further comprises:

(a) energy deriving means for deriving energy from rotational movement of said drill string relative to the cylindrical sidewall of said borehole, said energy deriving means being fixed to said drill string at a predetermined position axially spaced from said connected drill bit at which gravity induced sag in said drill string causes said energy deriving means to contact the low side portion of the sidewall during an interval of one rotation of said drill string and to avoid contact with the sidewall during the remaining interval of one rotation, said energy deriving means deriving energy only during periods of contact with the sidewall of said borehole; and (b) means utilizing the energy derived for pressurizing a source of fluid and for supplying pressurized fluid to said jet emitting means during periods of contact of said energy deriving means with the sidewall of said borehole.

7. An invention as defined in claim 6 wherein:

said energy deriving means comprises a roller member operatively attached to contact and roll against the low side portion of the cylindrical sidewall of said borehole, and said means utilizing the energy derived comprises a hydraulic pump and means connecting said roller member to operate said hydraulic pump upon rotation of said roller member.

8. An invention as defined in claim 5 or 6 wherein said cutter assembly comprises three offset cone cutter assemblies positioned on said drill bit to contact the drill face and gage corner at equally spaced circumferential intervals.

* * * * *